US011805886B2

(12) United States Patent
Arevalo

(10) Patent No.: US 11,805,886 B2
(45) Date of Patent: Nov. 7, 2023

(54) PAINT GUN HOLSTER ASSEMBLY

(71) Applicant: Rene Arevalo, Chattanooga, TN (US)

(72) Inventor: Rene Arevalo, Chattanooga, TN (US)

( * ) Notice: Subject to any disclaimer, the term of this patent is extended or adjusted under 35 U.S.C. 154(b) by 47 days.

(21) Appl. No.: 17/694,076

(22) Filed: Mar. 14, 2022

(65) Prior Publication Data

US 2023/0284770 A1 Sep. 14, 2023

(51) Int. Cl.
*A45F 3/14* (2006.01)
*A45F 3/00* (2006.01)

(52) U.S. Cl.
CPC ..... *A45F 3/14* (2013.01); *A45F 2003/003* (2013.01); *A45F 2003/144* (2013.01)

(58) Field of Classification Search
CPC ..... A45F 3/14; A45F 5/004
USPC ..... 224/162
See application file for complete search history.

(56) References Cited

U.S. PATENT DOCUMENTS 3,227,337 A * 1/1966 Santo, Jr. ..... F41C 33/0209 224/911
D251,758 S * 5/1979 Penrod ..... D3/229
4,830,247 A * 5/1989 Banks ..... B25H 3/006 224/678
4,884,730 A * 12/1989 Carpenter ..... A45B 1/04 224/901.4
5,009,022 A * 4/1991 McCoy ..... F41C 33/001 42/106
5,201,448 A * 4/1993 Schue ..... B25H 3/00 224/660
5,385,281 A * 1/1995 Byrd ..... B44D 3/123 224/663
5,464,136 A * 11/1995 Eddy ..... F41C 33/046 2/322
5,511,703 A * 4/1996 Ryerson ..... B25H 3/00 224/684
5,513,785 A * 5/1996 Campagna, Jr. ..... F41C 33/04 224/912
5,586,969 A * 12/1996 Yewer, Jr. ..... A61F 5/028 2/311
5,609,283 A * 3/1997 Harrison, Jr. ..... A45F 5/02 224/678
5,695,104 A * 12/1997 Darling ..... B25H 3/00 224/684
6,213,365 B1 * 4/2001 Stocke ..... A41D 13/0012 224/684

(Continued)

FOREIGN PATENT DOCUMENTS

CA 2986778 5/2019

*Primary Examiner* — Nathan J Newhouse
*Assistant Examiner* — Lester L Vanterpool

(57) ABSTRACT

A paint gun holster assembly includes a belt that can be worn around a user's waist. A pad is integrated into the belt and the pad is worn around the user's waist. A pair of holsters is each positioned on the pad and each of the holsters receives a respective one of a pair of paint guns to inhibit the paint guns from being dropped. A pair of retractors is each slidably positioned on the belt and each of the retractors includes a cord extending outwardly from the retractors. The cord on each of the retractors is biased into the retractors and the cord on each of the retractors is urgeable outwardly from the retractors. A pair of claws is each coupled to the cord associated with a respective one of the retractors. Each of the claws is engageable to a handle of a respective one of the paint guns to secure the paint guns to the belt.

11 Claims, 6 Drawing Sheets

(56) References Cited

U.S. PATENT DOCUMENTS 6,325,261 B1 * 12/2001 Webber ..... B05C 17/01 224/904
6,382,481 B1 * 5/2002 McIlmoil ..... A45F 5/004 224/245
6,390,348 B1 * 5/2002 Godshaw ..... B25H 3/00 224/660
6,398,092 B1 * 6/2002 Ansley ..... A61F 5/028 224/582
6,427,374 B1 * 8/2002 Vaiani ..... F41C 33/00 119/770
6,446,852 B1 * 9/2002 Sorensen ..... B25H 3/00 224/904
6,474,519 B1 * 11/2002 Cleveland ..... A45F 5/021 224/904
6,491,191 B1 * 12/2002 Cleveland ..... A45F 5/00 224/904
7,658,307 B2 * 2/2010 Skupin ..... A45F 5/004 224/675
8,322,586 B2 * 12/2012 Davis ..... B25H 3/006 224/232
8,794,560 B2 * 8/2014 Salentine ..... A45F 5/004 242/379.2
9,179,762 B2 * 11/2015 Paugh ..... H04B 1/3877
9,339,102 B2 * 5/2016 Iosilevich ..... A45F 3/14
D774,298 S * 12/2016 Mathews, Jr. ..... A45F 3/14 D3/228
10,299,572 B2 * 5/2019 Salentine ..... A45F 5/021
10,477,949 B2 * 11/2019 Wall ..... A45F 5/021
10,898,918 B2 * 1/2021 Rose ..... B05B 15/62
2002/0000455 A1 * 1/2002 Condliff ..... A45F 5/004 224/162
2003/0168483 A1 * 9/2003 Mabe ..... A45F 5/021 224/268
2003/0213823 A1 * 11/2003 Papovitch ..... A45F 5/02 224/269
2004/0144865 A1 * 7/2004 Boas ..... B05B 9/08 239/373
2005/0258203 A1 * 11/2005 Weaver ..... A45F 5/004 224/904
2007/0205235 A1 * 9/2007 Knight ..... A45F 5/00 224/681
2008/0041975 A1 * 2/2008 Sears ..... B05B 15/60 239/152
2009/0206175 A1 * 8/2009 Salvagno ..... A45F 5/021 239/154
2012/0024927 A1 * 2/2012 LaFontaine ..... A45F 5/021 224/682
2012/0168472 A1 * 7/2012 Mathews ..... A45F 5/021 224/162
2014/0374458 A1 * 12/2014 Roberts ..... A45F 3/14 224/660
2015/0305478 A1 * 10/2015 Krol ..... A45F 3/14 224/148.6
2017/0055687 A1 * 3/2017 Diaz ..... A45F 5/021
2020/0383459 A1 * 12/2020 Vinson ..... A45F 3/14
2022/0316839 A1 * 10/2022 Shipley ..... A45F 5/021

* cited by examiner (Cross-Section 1-1)

(Interior View)

PAINT GUN HOLSTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to holster devices and more particularly pertains to a new holster device for inhibiting paint guns from being dropped. The device includes a belt that is wearable around a waist of a user and a pair of holsters that is each slidably positioned on the belt. Each of the holsters insertably receives a paint gun for holding the paint gun when the paint gun is not being used. The device includes a pair of retractors that are each slidably integrated on the belt and a pair of clamps that is each attached to a respective retractor. Each of the clamps is attachable to a handle of a respective paint gun to inhibit the paint guns from being dropped.

(2) Description of Related Art Including Information Disclosed Under 37 CFR 1.97 and 1.98

The prior art relates to holster devices including a caulking gun holster that comprises a sleeve for insertably receiving a calking gun and a belt loop attached to the sleeve. The prior art discloses a holster for a spray gun that includes a plurality of rectangular slots and a pair of wire loops for supporting a spray gun. The prior art discloses a water nozzle holster that includes a waist belt and a holster attached to the waist belt that includes a curved member for supporting the water nozzle. The prior art discloses a spray gun holster that includes a waist belt and a holster comprising a wire loop that curves upwardly from the waist belt. The prior art discloses a holster harness that includes a body harness that is wearable on a torso of a user and a loop attached to the body harness for supporting a spray gun.

BRIEF SUMMARY OF THE INVENTION

An embodiment of the disclosure meets the needs presented above by generally comprising a belt that can be worn around a user's waist. A pad is integrated into the belt and the pad is worn around the user's waist. A pair of holsters is each positioned on the pad and each of the holsters receives a respective one of a pair of paint guns to inhibit the paint guns from being dropped. A pair of retractors is each slidably positioned on the belt and each of the retractors includes a cord extending outwardly from the retractors. The cord on each of the retractors is biased into the retractors and the cord on each of the retractors is urgeable outwardly from the retractors. A pair of claws is each coupled to the cord associated with a respective one of the retractors. Each of the claws is engageable to a handle of a respective one of the paint guns to secure the paint guns to the belt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
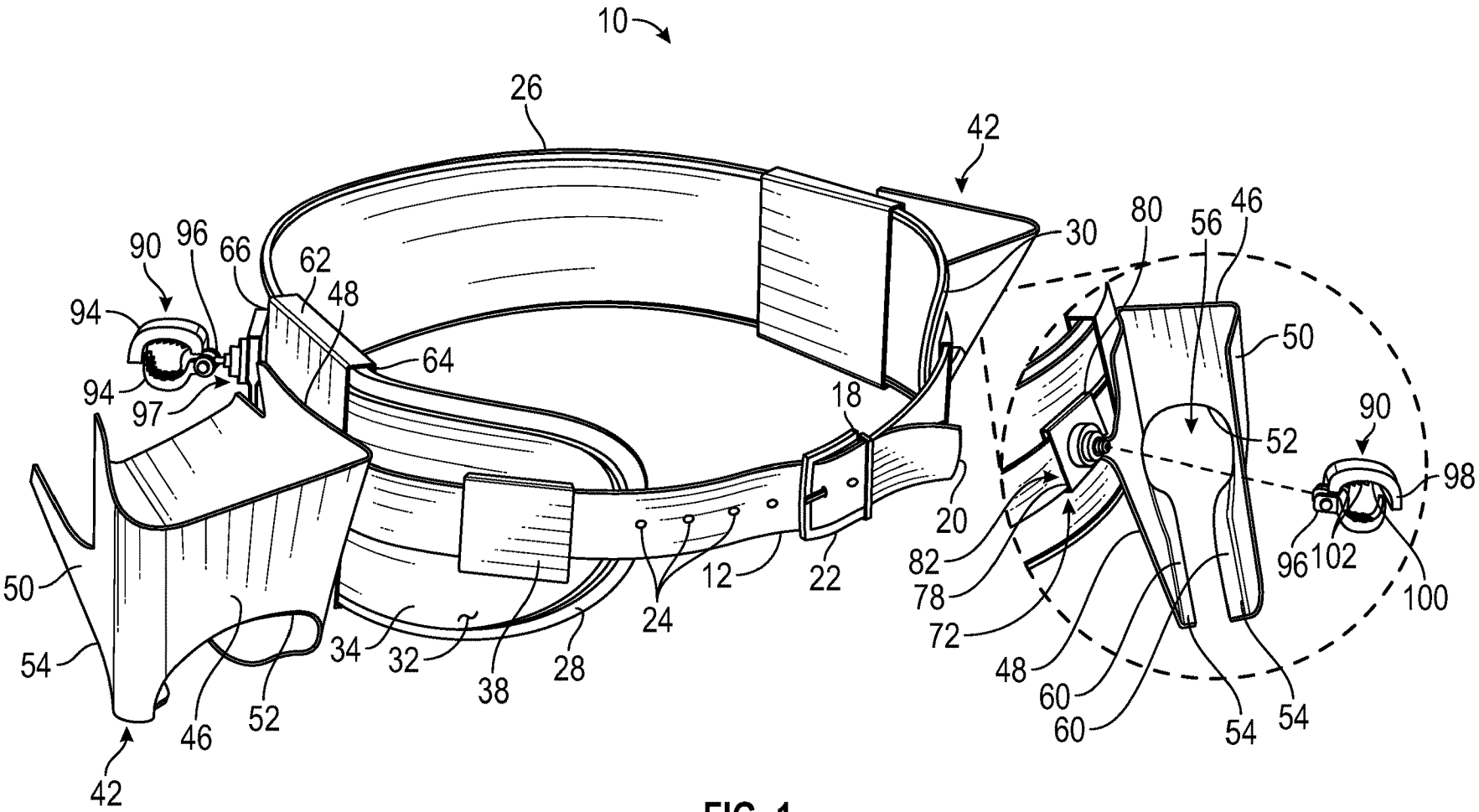
FIG. 1 is a front perspective view of a paint gun holster assembly according to an embodiment of the disclosure.
Figure 2:
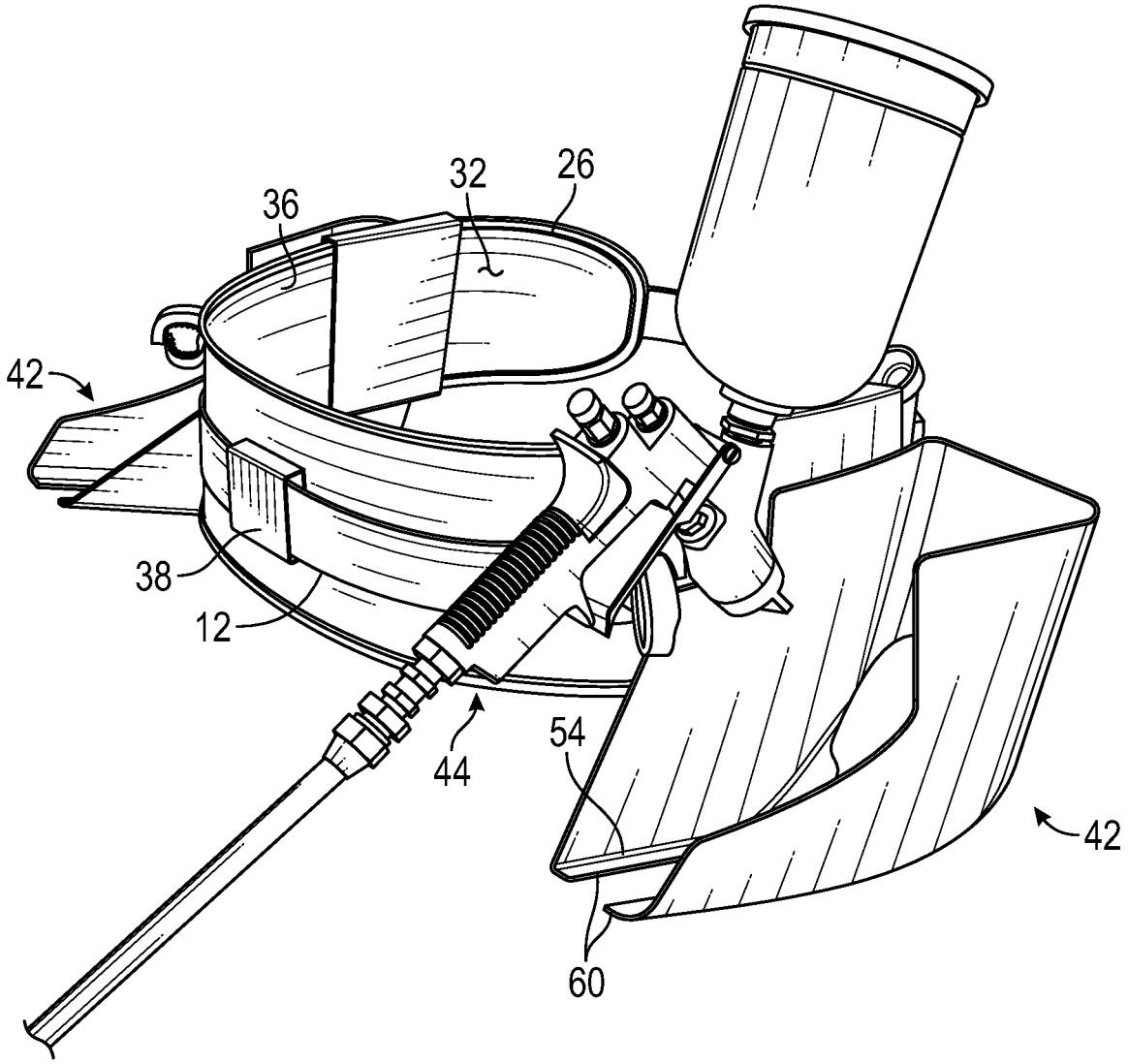
FIG. 2 is a back perspective view of an embodiment of the disclosure showing a spray gun being inserted into a holster.
Figure 3:
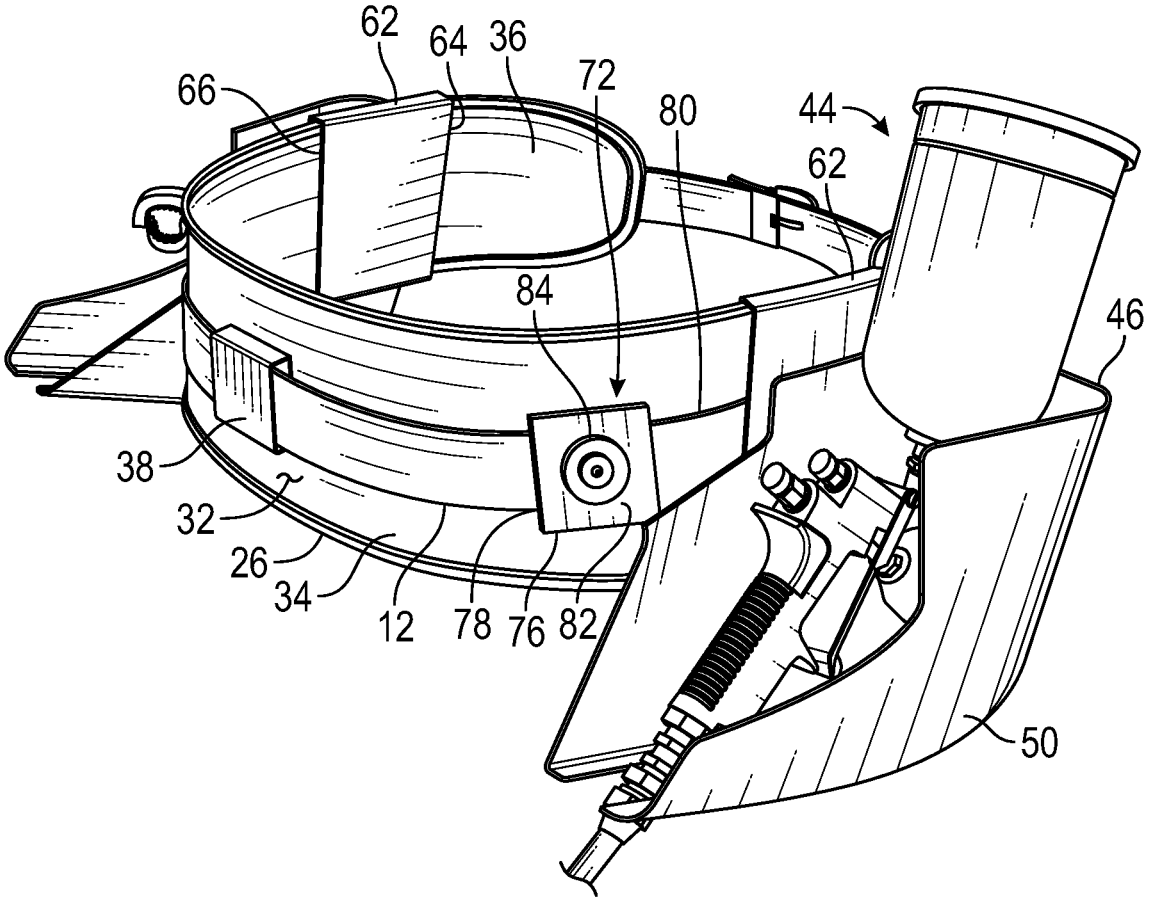
FIG. 3 is a back perspective view of an embodiment of the disclosure showing a spray gun being positioned in a holster.
Figure 4:
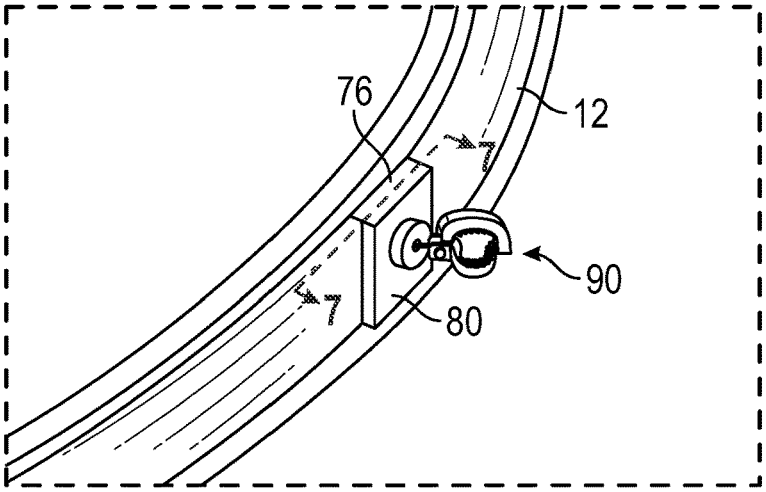
FIG. 4 is a perspective view retractor of an embodiment of the disclosure.
Figure 5:
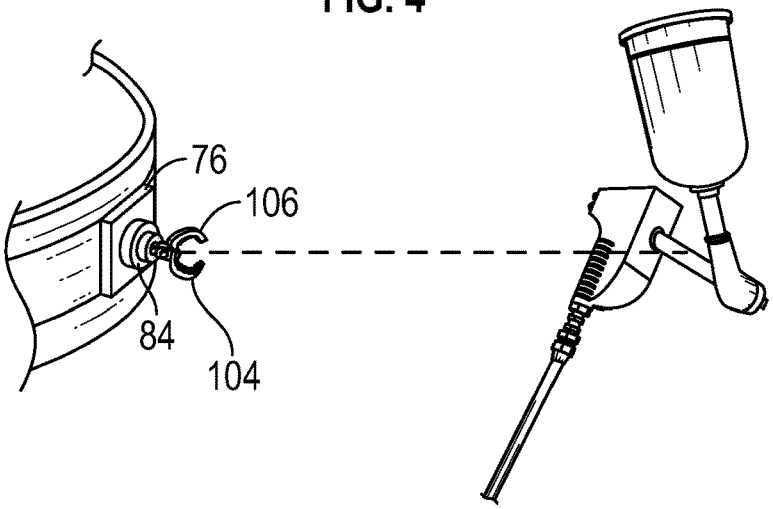
FIG. 5 is a perspective view of an embodiment of the disclosure showing a spray gun being inserted into a clamp.
Figure 6:
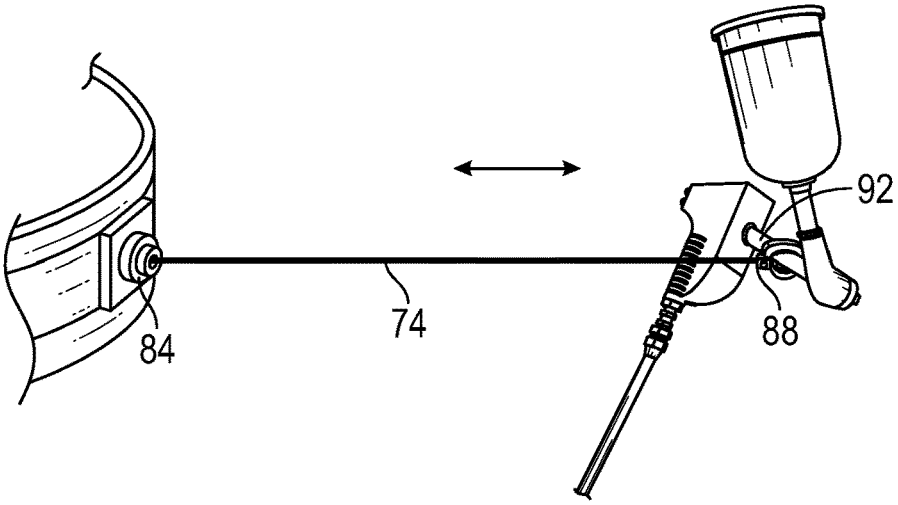
FIG. 6 is a perspective view of an embodiment of the disclosure showing a spray gun being attached to a retractor.
Figure 7:
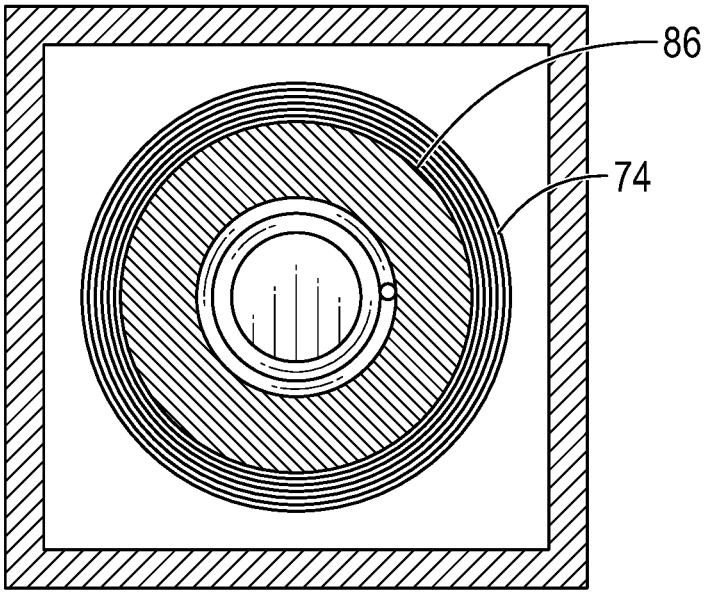
FIG. 7 is a cross sectional view taken along line 7-7 of FIG. 4 of an embodiment of the disclosure.
Figure 8:
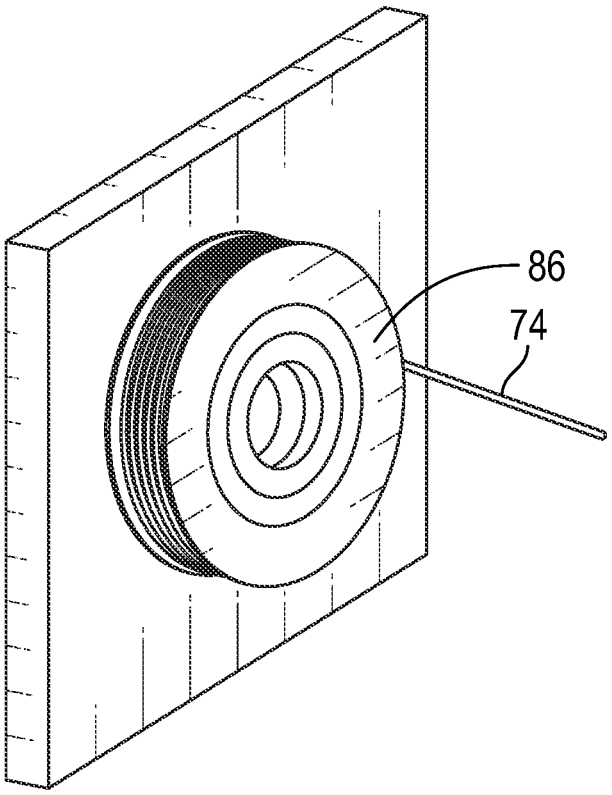
FIG. 8 is a cut-away view of a retractor an embodiment of the disclosure.
Figure 9:
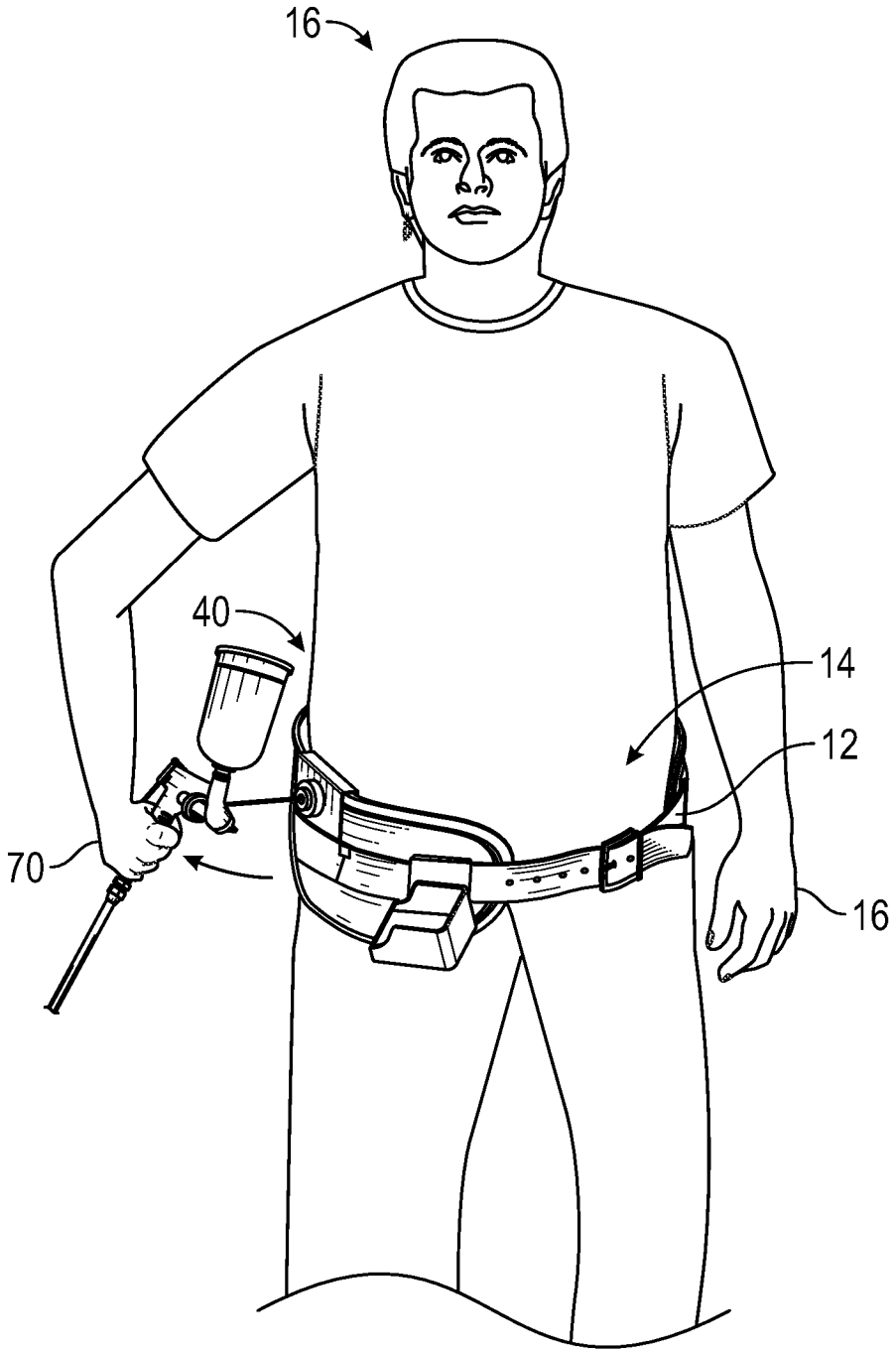
FIG. 9 is a perspective in-use view of an embodiment of the disclosure.

With reference now to the drawings, and in particular to FIGS. 1 through 9 thereof, a new holster device embodying the principles and concepts of an embodiment of the disclosure and generally designated by the reference numeral 10 will be described.

As best illustrated in FIGS. 1 through 9, the paint gun holster assembly 10 generally comprises a belt 12 that can be worn around a user's waist 14. The user 16 may be a professional painter or other individual that commonly employs pneumatic paint guns 44. The belt 12 has a first end 18 and a second end 20, and the belt 12 is elongated between the first end 18 and the second end 20. The belt 12 has a buckle 22 that is coupled to the first end 18 and the second end 20 is extendable through the buckle 22 such that the belt 12 forms a closed loop. The belt 12 has a plurality of engagement points 24 being distributed from the second end 20 toward the first end 18. Furthermore, the buckle 22 engages a respective one of the engagement points 24 for adjusting a diameter of the closed loop formed by the belt 12.

A pad 26 is provided and the belt 12 is integrated into the pad 26 thereby facilitating the pad 26 to be worn around the user's waist 14. The pad 26 has a primary end 28, a secondary end 30 and an outer surface 32 extending between the primary end 28 and the secondary end 30. The pad 26 is elongated between the primary end 28 and the secondary end 30, and the outer surface 32 has an outwardly facing side 34 and an inwardly facing side 36. A plurality of loops 38 is each coupled to the outwardly facing side 34 and the loops 38 are spaced apart from each other and are distributed between the primary end 28 and the secondary end 30. The belt 12 extends through each of the loops 38. Additionally, the pad 26 has a height that is greater than a height of the belt 12 such that the pad 26 can support the user's lower back 40 when the pad 26 is worn around the user's waist 14.

A pair of holsters 42 is provided and each of the holsters 42 is positioned on the pad 26. Each of the holsters 42 receives a respective one of a pair of paint guns 44 to inhibit the paint guns 44 from being dropped. The paint guns 44 may be pneumatic paint guns of any conventional design that might be employed for painting an exterior of a house, for example. Each of the holsters 42 has a front wall 46, a first lateral wall 48 and a second lateral wall 50. The front wall 46 has a lower edge 52 and each of the first lateral wall 48 and the second lateral wall 50 has a bottom edge 54. The lower edge 52 of the front wall 46 curves upwardly to define an opening 56 to insertably receive an output nozzle 58 of the paint gun 44.

Each of the first lateral wall 48 and the second lateral wall 50 has a lip 60 that is perpendicularly oriented with the bottom edge 54. The lip 60 on each of the first lateral wall 48 and the second lateral wall 50 is directed toward each other such that the lip 60 on each of the first lateral wall 48 and the second lateral wall 50 supports the paint gun 44. Additionally, each of the holsters 42 has a sleeve 62 that is coupled to the first lateral wall 48. The sleeve 62 has a front end 64 and a back end 66, and each of the front end 64 and the back end 66 is open. The pad 26 extends through the front end 64 and the back end 66 of the sleeve 62 on each of the holsters 42 for slidably retaining the holsters 42 on the pad 26. Each of the holsters 42 is positionable adjacent to a respective one of the primary end 28 and the secondary end 30 of the pad 26. In this way each of the holsters 42 is accessible to a respective one of the user's left hand 68 and right hand 70.

A pair of retractors 72 is each slidably positioned on the belt 12 and each of the retractors 72 includes a cord 74 which extends outwardly from the retractors 72. The cord 74 on each of the retractors 72 is biased into the retractors 72 and the cord 74 on each of the retractors 72 is urgeable outwardly from the retractors 72. Each of the retractors 72 comprises a housing 76 that has a rear wall 78, a forward wall 80 and a lateral wall 82 extending between the rear wall 78 and the forward wall 80. The housing 76 has a slot 83 extending through the rear wall 78 and the forward wall 80 and the slot 83 insertably receives the belt 12 such that the housing 76 is slidably retained on the belt 12. Furthermore, a nozzle 84 is disposed on the lateral wall 82, the nozzle 84 is hollow and the nozzle 84 is in communication with an interior of the housing 76.

Each of the retractors 72 includes a spool 86 that is rotatably positioned within the housing 76. The spool 86 is biased to rotate in a first direction and the spool 86 is rotatable in a second direction. The cord 74 is wrapped around the spool 86 and the cord 74 extends outwardly through the nozzle 84 in the lateral wall 82. Additionally, the cord 74 has a distal end 88 that is exposed with respect to the nozzle 84. The housing 76 associated with each of the retractors 72 is slid along the belt 12 to position the housing 76 of each of the retractors 72 next to a respective one of the holsters 42.

A pair of claws 90 is provided and each of the claws 90 is coupled to the cord 74 associated with a respective one of the retractors 72. Each of the claws 90 is engageable to a handle 92 of a respective one of the paint guns 44 to secure the paint guns 44 to the belt 12. Each of the claws 90 has a pair of jaws 94 that is each pivotally coupled to a pivot point 96. The jaws 94 are biased together and the jaws 94 are urgeable apart from each other. The pivot point 96 is coupled to the distal end 88 of the cord 74 associated with the respective retractor.

Each of the jaws 94 has a distal end 98 with respect to the pivot point 96 and an engaging surface 100 extending between the pivot point 96 and the distal end 98 of the jaws 94. The engaging surface 100 of each of the jaws 94 is curved between the pivot point 96 and the distal end 98 of the jaws 94. Additionally, the engaging surface 100 of each of the jaws 94 has a plurality of teeth 102 that is integrated into the engaging surface 100 such that each of the teeth 102 on the engaging surface 100 of each of the jaws 94 grips the handle 92 of the respective paint gun. The pair of jaws 94 includes a first jaw 104 and a second jaw 106. The first jaw 104 has a length that is less than a length of the second jaw 106 such that the distal end 98 of the first jaw 104 engages the engaging surface 100 of the second jaw 106 when the first jaw 104 and the second jaw 106 are biased together.

In use, the belt 12 is worn around the user's waist 14 and each of the paint guns 44 is positioned in a respective holster 42. Each of the claws 90 is engaged to the handle 92 of a respective paint gun 44. In this way the user 16 can climb a ladder, for example, or perform other activities without worrying about dropping the paint guns 44. Additionally, the retractors 72 inhibit the paint guns 44 from falling to the ground should the user 16 inadvertently drop the paint guns 44 while painting. In this way the paint guns 44 are protected from being damaged due to being dropped.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint gun holster assembly for inhibiting paint guns from being dropped while climbing a ladder, said assembly comprising:

a belt being configured to be worn around a user's waist;

a pad having said belt being integrated into said pad wherein said pad is configured to be worn around the user's waist;

a pair of holsters, each of said holsters being positioned on said pad, each of said holsters having a respective one of a pair of paint guns being positioned therein wherein each of said holsters is configured to inhibit the paint guns from being dropped;

a pair of retractors, each of said retractors being slidably positioned on said belt, each of said retractors including a cord extending outwardly from said retractors, said cord on each of said retractors being biased into said retractors, said cord on each of said retractors being urgeable outwardly from said retractors; and a pair of claws, each of said claws being coupled to said cord associated with a respective one of said retractors, each of said claws being engageable to a handle of a respective one of the paint guns to secure the paint guns to said belt.

2. The assembly according to claim 1, wherein said belt has a first end and a second end, said belt being elongated between said first end and said second end, said belt having a buckle being coupled to said first end, said second end being extendable through said buckle such that said belt forms a closed loop, said belt having a plurality of engagement points being distributed from said second end toward said first end, said buckle engaging a respective one of said engagement points for adjusting a diameter of said closed loop formed by said belt.

3. The assembly according to claim 2, wherein:

said pad has a primary end, a secondary end and an outer surface extending between said primary end and said secondary end, said pad being elongated between said primary end and said secondary end, said outer surface having an outwardly facing side and an inwardly facing side;

said pad having a plurality of loops each being coupled to said outwardly facing side, said loops being spaced apart from each other and being distributed between said primary end and said secondary end, said belt extending through each of said loops; and said pad having a height being greater than a height of said belt wherein said pad is configured to support the user's lower back when said pad is worn around the user's waist.

4. The assembly according to claim 1, wherein each of said holsters has a front wall, a first lateral wall and a second lateral wall, said front wall having a lower edge, each of said first lateral wall and said second lateral wall having a bottom edge, said lower edge of said front wall curving upwardly to define an opening for insertably receiving an output nozzle of the paint gun, each of said first lateral wall and said second lateral wall having a lip being perpendicularly oriented with said bottom edge, said lip on each of said first lateral wall and said second lateral wall being directed toward each other such that said lip on each of said first lateral wall and said second lateral wall supports the paint gun.

5. The assembly according to claim 4, wherein:

said pad has a primary end and a secondary end; and each of said holsters has a sleeve being coupled to said first lateral wall, said sleeve having a front end and a back end, each of said front end and said back end being open, said pad extending through said front end and said back end of said sleeve on each of said holsters for slidably retaining said holsters on said pad, each of said holsters being positionable adjacent to a respective one of said primary end and said secondary end of said pad wherein each of said holsters is configured to be accessible to a respective one of the user's left hand and right hand.

6. The assembly according to claim 1, wherein each of said retractors comprises a housing having a rear wall, a forward wall and a lateral wall extending between said rear wall and said forward wall, said housing having a slot extending through said rear wall and said forward wall, said slot insertably receiving said belt such that said housing is slidably retained on said belt, said lateral wall having a nozzle being disposed on said lateral wall, said nozzle being hollow, said nozzle being in communication with an interior of said housing.

7. The assembly according to claim 6, wherein each of said retractors includes a spool being rotatably positioned within said housing, said spool being biased to rotate in a first direction, said spool being rotatable in a second direction, said cord being wrapped around said spool, said cord extending outwardly through said nozzle in said lateral wall, said cord having a distal end being exposed with respect to said nozzle.

8. The assembly according to claim 7, wherein each of said claws has a pair of jaws each being pivotally coupled to a pivot point, said jaws being biased together, said jaws being urgeable apart from each other, said pivot point being coupled to said distal end of said cord associated with said respective retractor.

9. The assembly according to claim 8, wherein each of said jaws has a distal end with respect to said pivot point and an engaging surface extending between said pivot point and said distal end of said jaws, said engaging surface of each of said jaws being curved between said pivot point and said distal end of said jaws, said engaging surface of each of said jaws having a plurality of teeth being integrated into said engaging surface such that each of said teeth on said engaging surface of each of said jaws grips the handle of the respective paint gun.

10. The assembly according to claim 9, wherein said pair of jaws includes a first jaw and a second jaw, said first jaw having a length being less than a length of said second jaw such that said distal end of said first jaw engages said engaging surface of said second jaw when said first jaw and said second jaw are biased together.

11. A paint gun holster assembly for inhibiting paint guns from being dropped while climbing a ladder, said assembly comprising:

a belt being configured to be worn around a user's waist, said belt having a first end and a second end, said belt being elongated between said first end and said second end, said belt having a buckle being coupled to said first end, said second end being extendable through said buckle such that said belt forms a closed loop, said belt having a plurality of engagement points being distributed from said second end toward said first end, said buckle engaging a respective one of said engagement points for adjusting a diameter of said closed loop formed by said belt;

a pad having said belt being integrated into said pad wherein said pad is configured to be worn around the user's waist, said pad having a primary end, a secondary end and an outer surface extending between said primary end and said secondary end, said pad being elongated between said primary end and said secondary end, said outer surface having an outwardly facing side and an inwardly facing side, said pad having a plurality of loops each being coupled to said outwardly facing side, said loops being spaced apart from each other and being distributed between said primary end and said secondary end, said belt extending through each of said loops, said pad having a height being greater than a height of said belt wherein said pad is configured to support the user's lower back when said pad is worn around the user's waist;

a pair of holsters, each of said holsters being positioned on said pad, each of said holsters having a respective one of a pair of paint guns being positioned therein wherein each of said holsters is configured to inhibit the paint guns from being dropped, each of said holsters having a front wall, a first lateral wall and a second lateral wall, said front wall having a lower edge, each of said first lateral wall and said second lateral wall having a bottom edge, said lower edge of said front wall curving upwardly to define an opening for insertably receiving an output nozzle of the paint gun, each of said first lateral wall and said second lateral wall having a lip being perpendicularly oriented with said bottom edge, said lip on each of said first lateral wall and said second lateral wall being directed toward each other such that said lip on each of said first lateral wall and said second lateral wall supports the paint gun, each of said holsters having a sleeve being coupled to said first lateral wall, said sleeve having a front end and a back end, each of said front end and said back end being open, said pad extending through said front end and said back end of said sleeve on each of said holsters for slidably retaining said holsters on said pad, each of said holsters being positionable adjacent to a respective one of said primary end and said secondary end of said pad wherein each of said holsters is configured to be accessible to a respective one of the user's left hand and right hand;

a pair of retractors, each of said retractors being slidably positioned on said belt, each of said retractors including a cord extending outwardly from said retractors, said cord on each of said retractors being biased into said retractors, said cord on each of said retractors being urgeable outwardly from said retractors, each of said retractors comprising:

a housing having a rear wall, a forward wall and a lateral wall extending between said rear wall and said forward wall, said housing having a slot extending through said rear wall and said forward wall, said slot insertably receiving said belt such that said housing is slidably retained on said belt, said lateral wall having a nozzle being disposed on said lateral wall, said nozzle being hollow, said nozzle being in communication with an interior of said housing; and a spool being rotatably positioned within said housing, said spool being biased to rotate in a first direction, said spool being rotatable in a second direction, said cord being wrapped around said spool, said cord extending outwardly through said nozzle in said lateral wall, said cord having a distal end being exposed with respect to said nozzle; and a pair of claws, each of said claws being coupled to said cord associated with a respective one of said retractors, each of said claws being engageable to a handle of a respective one of the paint guns to secure the paint guns to said belt, each of said claws having a pair of jaws each being pivotally coupled to a pivot point, said jaws being biased together, said jaws being urgeable apart from each other, said pivot point being coupled to said distal end of said cord associated with said respective retractor, each of said jaws having a distal end with respect to said pivot point and an engaging surface extending between said pivot point and said distal end of said jaws, said engaging surface of each of said jaws being curved between said pivot point and said distal end of said jaws, said engaging surface of each of said jaws having a plurality of teeth being integrated into said engaging surface such that each of said teeth on said engaging surface of each of said jaws grips the handle of the respective paint gun, said pair of jaws including a first jaw and a second jaw, said first jaw having a length being less than a length of said second jaw such that said distal end of said first jaw engages said engaging surface of said second jaw when said first jaw and said second jaw are biased together.

* * * * *